US006474954B1

(12) United States Patent
Bell et al.

(10) Patent No.: US 6,474,954 B1
(45) Date of Patent: Nov. 5, 2002

(54) COMPRESSOR COOLING SYSTEM

(75) Inventors: Anthony D. Bell, Calhoun, LA (US); Brian M. Steurer, Ringgold, GA (US)

(73) Assignee: Thomas Industries Inc., Monroe, LA (US)

( * ) Notice: Subject to any disclaimer, the term of this patent is extended or adjusted under 35 U.S.C. 154(b) by 0 days.

(21) Appl. No.: 09/636,428

(22) Filed: Aug. 10, 2000

(51) Int. Cl.[7] ..... F04B 23/14

(52) U.S. Cl. ..... 417/201; 417/372; 92/171.1; 60/456

(58) Field of Search ..... 417/201, 372, 417/423.8; 92/171.1; 60/456

(56) References Cited

U.S. PATENT DOCUMENTS

| | | | | | |
|---|---|---|---|---|---|
| 2,064,461 | A | | 12/1936 | Chilton et al. | 257/251 |
| 3,316,888 | A | | 5/1967 | Bachle | |
| 3,808,955 | A | | 5/1974 | Hamada et al. | |
| 3,844,334 | A | | 10/1974 | Frederickson | 164/132 |
| 3,961,869 | A | * | 6/1976 | Droege, Sr. et al. | 91/171.1 |
| 4,190,402 | A | | 2/1980 | Meece et al. | |
| 4,492,533 | A | | 1/1985 | Tsuge | |
| 4,653,161 | A | | 3/1987 | Sanchez | |
| 4,700,444 | A | | 10/1987 | Yamagata | |
| 4,854,825 | A | | 8/1989 | Bez et al. | |
| 5,022,455 | A | * | 6/1991 | Takeda et al. | 164/46 |
| 5,255,433 | A | | 10/1993 | Jin et al. | |
| 5,584,675 | A | | 12/1996 | Steurer et al. | |
| 5,630,355 | A | | 5/1997 | Ikeda et al. | |
| 5,957,667 | A | * | 9/1999 | Epp | 417/372 |
| 6,085,833 | A | * | 7/2000 | Kimura et al. | 165/185 |

FOREIGN PATENT DOCUMENTS

| | | | |
|---|---|---|---|
| EP | 0400334 A2 | 12/1990 | |
| GB | 1542926 | 4/1976 | |
| GB | 2175653 A | 12/1986 | 164/132 |

* cited by examiner

*Primary Examiner*—Cheryl J. Tyler
(74) *Attorney, Agent, or Firm*—Quarles & Brady LLP

(57) ABSTRACT

Disclosed herein is an oilless air compressor having a cooling system with a drive unit operating a crankshaft disposed within a crankcase and to which is attached a pair of pistons movable within corresponding compression cylinders. A blower wheel is concentrically mounted to the crankshaft adjacent the exterior of the crankcase. Each compression cylinder includes a thermally conductive cylinder insert which a bore in which the corresponding piston rides. A thermally conductive heat sink having a plurality of annular cooling fins is cast integrally to the outer diameter of each cylinder insert and connected to the crankcase such that the compression cylinders and the crankcase are completely enclosed. Each cylinder insert is made of an aluminum alloy, preferably having a low silicon content and a high melting point so that it can be insert cast within the cooling fin and anodized without degrading the surface finish of its inner bore.

16 Claims, 2 Drawing Sheets

COMPRESSOR COOLING SYSTEM

CROSS-REFERENCE TO RELATED APPLICATIONS

Not applicable.

STATEMENT REGARDING FEDERALLY SPONSORED RESEARCH/DEVELOPMENT

Not applicable.

BACKGROUND OF THE INVENTION

The present invention relates to air compressors, and in particular to a system for cooling air compressors.

Many types and constructions of air compressors are known in the art. While some use rotating impellers to pressurize the air, positive displacement compressors are most common. Positive displacement compressors include a piston, crankshaft, connecting rod, cylinder and valve head. Typical compressors have one or two cylinders and a corresponding number of pistons. Two cylinder compressors operate the same as single cylinder compressors, however, each revolution of the crankshaft causes two compression strokes, one for each piston.

The crankshaft is ordinarily powered by an electric motor or a gas engine. At the top of the cylinder, there is a valve head having inlet and discharge valves controlling the passage of air into and out of the cylinder. As the crankshaft is rotated, the connecting rod moves the piston up and down within the cylinder. As the piston moves down, a vacuum is created which draws outside air past the inlet valve and into the cylinder. As the piston moves up, the air in the cylinder is compressed which shuts the inlet valve and opens the discharge valve. Compression of the air also generates considerable heat.

Many positive displacement compressors are designed with an oil bath that splashes the connecting rod bearings and cylinder walls. For such compressors, one or more annular compression rings on the pistons seal against the inner diameter of the cylinders so that the lubricating oil does not mix with the compressed air. Often, however, the compression rings are not completely effective to prevent the oil from entering in the compressed air in aerosol form, which is intolerable in some applications. Also, oil lubricated compressors require maintenance and replacement of the oil as well as that the compressor be operated on a generally level surface.

Oilless compressors provide a solution to these problems. Typically, such compressors use sealed connecting rod bearings and compression rings made of a self-lubricating material, such as PTFE. However, because there is no oil to lubricate the moving parts, the temperature within the crankcase and cylinders is higher. And, since self-lubricating materials, like most materials, degrade over time in high temperature environments, the useful life of the compression rings is directly related to the effectiveness of the cooling system of the compressor.

Some compressors have an open crankcase allowing outside air to pass therethrough to cool the cylinders and compression rings. However, compressors with open crankcases are often noisy and can require additional maintenance due to dust and debris entering the crankcase and damaging the connecting rod bearings, compression rings and/or cylinder walls. As such, it is desirable to completely enclose the crankcase. Compressors with enclosed crankcases use blower wheels operated by the drive motor to direct air past the exterior of the crankcase and cylinders.

Often, however, such a design does not adequately cool the cylinders and compression rings. This is because the cylinders are ordinarily made of cast iron. Cast iron provides a hard, smooth inner bore creating a low-friction bearing surface for the compression ring, and the casting process provides a cost effective means of forming cooling fins around the cylinder. However, cast iron has a relatively low thermal conductively, roughly half that of aluminum.

One solution is disclosed in U.S. Pat. No. 4,492,533 issued to Tsuge on Jan. 8, 1985. Here, the air compressor has its drive unit, crankcase and cylinders confined within a sound-proof box. The compressor includes a fan and the box has air inlet and outlet openings. The crankcase also has a plurality of bores defining passages for air to travel to cool the connector rod bearings and piston rings. While this design solves some of the aforementioned problems, it requires a sound-proof box, which is not totally enclosed so that the debris can enter and increase friction between moving parts.

Accordingly, a need exists in the art for an improved cooling system for an oilless air compressor with a completely enclosed crankcase.

SUMMARY OF THE INVENTION

The present invention provides an oilless air compressor having a cooling system with a drive unit operating a crankshaft disposed within a crankcase and to which is attached a piston movable within a compression cylinder. The compression cylinder includes a thermally conductive aluminum alloy cylinder insert having a bore in which the corresponding piston rides. A thermally conductive aluminum alloy heat sink structure is cast integrally to the outer diameter of each cylinder insert and the cylinder is connected to the crankcase such that the compression cylinder and the crankcase are completely enclosed.

The cylinder insert is preferably made of a low silicon, high melting point aluminum alloy, preferably having a silicon content of less than one percent and a melting point of more than 600 degrees Celsius.

In one preferred form, the present invention includes an oilless air compressor having a positive displacement compressor unit with a pair of reciprocating pistons movable within a pair of offset compression cylinders forming a V-configuration. Each compression cylinder includes a thermally conductive and low silicon aluminum alloy cylinder insert and a thermally conductive aluminum alloy heat sink structure cast integrally to the outer diameter of the cylinder insert. The heat sink includes a plurality of annular cooling fins. A drive unit operates a crankshaft within a completely enclosed crankcase to reciprocate the pistons within the compression cylinders. A blower wheel external to the crankcase is rotated by the drive unit to direct air past the heat sink to cool the internal components of the compressor.

Thus, the present invention provides an air compressor in which the crankcase can be completely enclosed without requiring cooling air to pass therethrough. This allows the air compressor to operate quieter than open crankcase compressors and prevents premature wear of piston seals, cylinders and crankshaft bearings. Even though the crankcase is completely enclosed, it is cooled sufficiently by blowing external air past the outside of uniquely constructed compression cylinders having a cylinder insert and a heat sink, both made of an aluminum alloy having a high thermal conductivity. Moreover, the aluminum alloy has a high melting point so that the heat sink can be cast about the cylinder insert without losing structural integrity during the casting process. Still further, the aluminum alloy has a low silicon content so that the inner diameter of the cylinder insert can be machined to a smooth finish after the casting process and then anodized to a suitable hardness, without degradation of the surface finish. As such, only one machining operation is required, which lowers cost.

The foregoing and other objects and advantages of the invention will appear from the following description. In this description reference is made to the accompanying drawings which form a part hereof and in which there is shown by way of illustration a preferred embodiment of the invention. Such embodiment does not necessarily represent the full scope of the invention, however, and reference must be made therefore to the claims for interpreting the scope of the invention.

DETAILED DESCRIPTION OF THE PREFERRED EMBODIMENT

Figure 1:
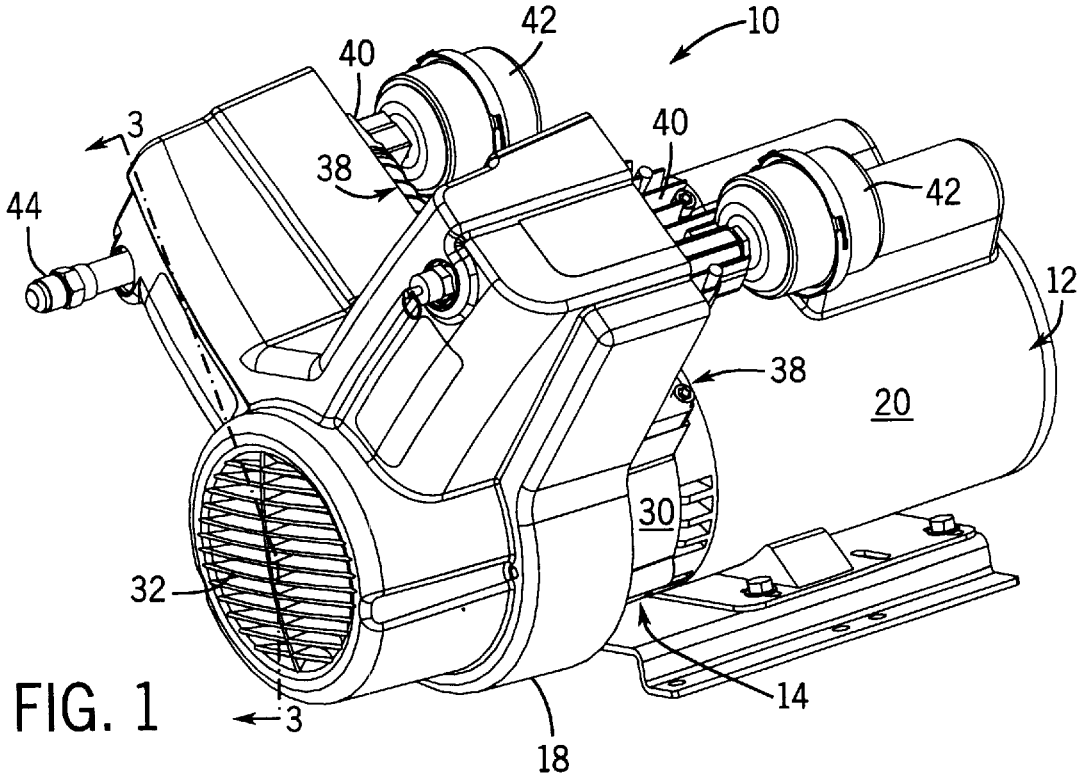
FIG. 1 is a perspective view of an air compressor having an encapsulated crankcase and a cooling system of the present invention.
Figure 2:
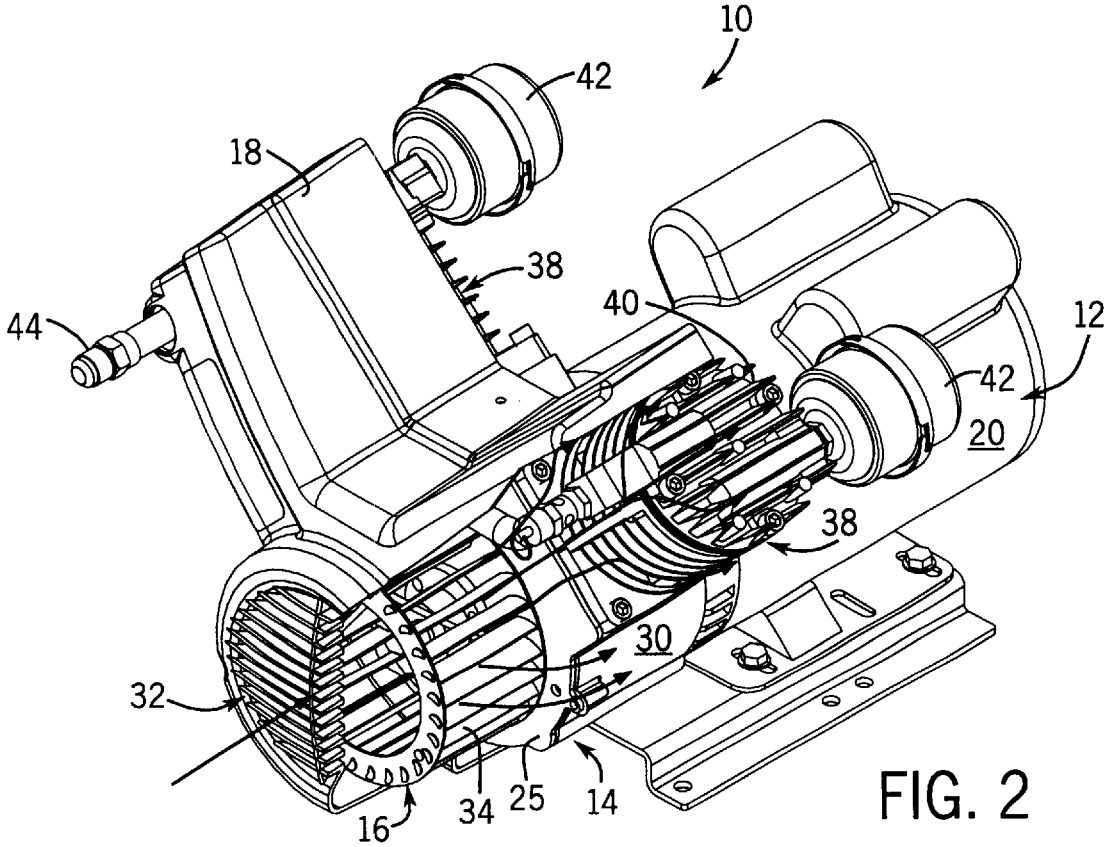
FIG. 2 is a perspective view similar to FIG. 1 with part of a shroud cut-away and arrows showing the flow path of cooling air past the crankcase and heat sink.
Figure 3:
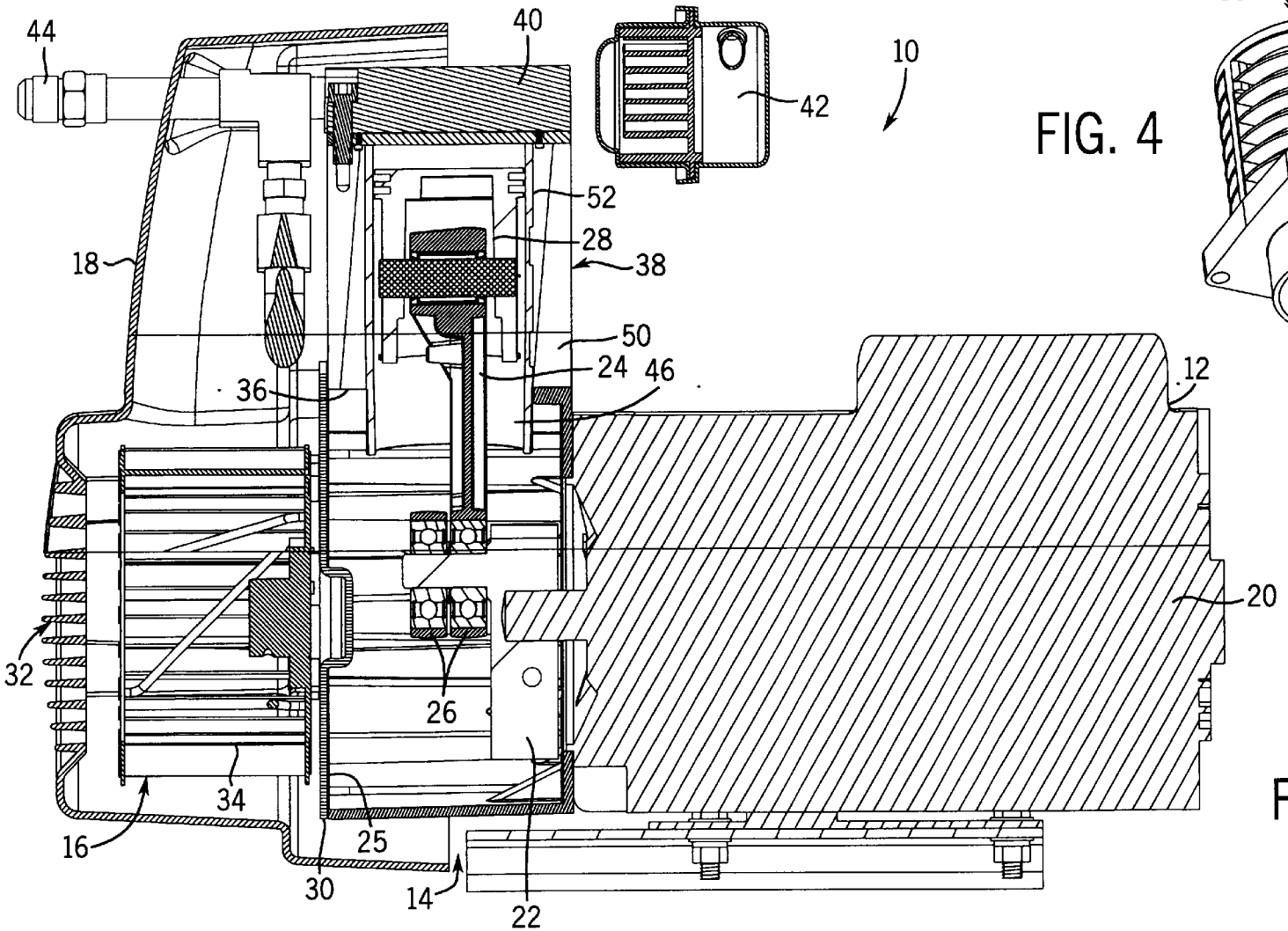
FIG. 3 is a cross-sectional view along line 3—3 of FIG. 1 showing one cylinder in the encapsulated crankcase of the compressor.

Referring to FIGS. 1–3, the air compressor of the present invention is referred to generally by reference numeral 10. The air compressor 10 includes as main components a drive unit 12, a compressor unit 14, a blower wheel 16 and a protective shroud 18. The drive unit 12 is comprised of an electric motor 20 and an eccentric crankshaft 22. The compressor unit 14 is a positive displacement type having a pair of connecting rods 24 pivotably mounted to the crankshaft 22 via bearings 26. Each connecting rod 24 is pivotably connected to a cylindrical piston 28. A crankcase 30 mounts to the face of the electric motor 20 and encloses the crankshaft 22 and the connecting rods 24. Opposite the drive unit 12, the crankcase 30 has an open end that is covered by a cap plate 25 sealed to the crankcase by a suitable gasket and suitable fasteners (not shown). The cap plate 25 includes a central bore through which a straight end of the crankshaft 22 extends that supports the blower wheel 16. A suitable ring seal (not shown) can be used to seal the central bore around the crankshaft 22. The blower wheel 16 can be of any suitable configuration, such as a squirrel cage configuration, known in the art, having a plurality of axial extending cupped blades 34. The crankcase 30 also has a pair of angled cylinder openings 36 at its top through which the pistons 28 extend. Compression cylinders 38 (described in detail below) are mounted over the cylinder openings 36 so that they are offset with respect to each other in the standard V-configuration. Each compression cylinder 38 is capped by a valve head 40 having an ambient air inlet valve in communication with an upstream air filter/silencer unit 42 and a compressed air outlet valve in communication with a downstream fitting 44 for attaching hosing from air powered equipment (not shown). The shroud 18 covers the blower wheel 16, crankcase 30 and compression cylinders 38 and has a grill 32 allowing air to be drawn in by the blower wheel 16.

Figure 4:
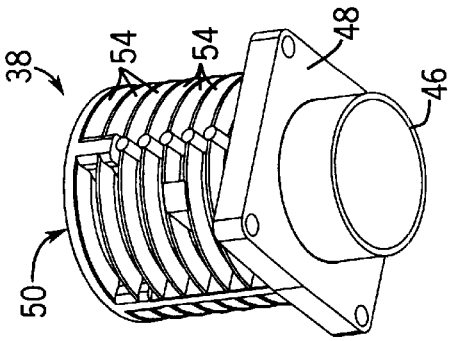
FIG. 4 is a perspective view of one cylinder having a finned heat sink cast to a sleeve-like cylinder insert.

Referring to FIG. 4, according to the present invention, each compression cylinder 38 is formed of a cylinder insert 46, mounting plate 48 and a heat sink 50. The cylinder insert 46 is formed as a separate component while the mounting plate 48 and heat sink 50 are cast integrally together. The cylinder insert 46 is a hollow, open-ended cylinder having an inner diameter sized according to the outer diameter of compression rings 52 fit about the circumference of the pistons 28 (see FIG. 3). The compression rings 52 are preferably made of a self lubricating polytetrafluoroethylene (PTFE) material.

Preferably, the mounting plate 48 and the heat sink 50 are formed integral with one another in a die casting process in which the cylinder insert 46 is included within the casting mold. In this way, a plurality of annular fins 54 can be integrally cast around the cylinder insert 46. The integral connection between the cylinder insert 46 and the fins 54 provides an uninterrupted path for conductive heat transfer to occur. Although there is no fusion of the insert 46 to the heat sink 50, the close surface contact between the two components and the high thermal conductivity of the two materials results in a high thermal conductivity of the composite structure. It should be noted that it may also be possible to choose materials and perform the heat sink casting process with some fusion between the outside of the insert 46 and the heat sink 50, but while preserving the structural integrity of the inner surface of the insert 46.

After the fins 54 are die cast to the cylinder insert 46, the inner diameter of the cylinder insert 46 is machined to final size and a high surface finish to provide a smooth bearing surface against which the compression rings 52 slide. Preferably, the inner diameter has a surface smoothness of 5–15 rms. The inner diameter of the cylinder insert 46 is then anodized to obtain a suitable hardness and wearing surface. The surface finish of the inner diameter is substantially maintained from the original machining operation, preferably being within 10–30 rms. of the original finish, thereby eliminating the need to perform secondary bore finish and reducing cost.

Each mounting plate 48 and heat sink 50 are preferably made of a standard aluminum alloy suitable for casting, such as 380 die cast aluminum. Preferable chemical composition limits for the 380 die cast aluminum are: 3.5% copper, 8.5% silicon, 1.3% iron, 0.5% manganese, 0.5% nickel, 0.1% magnesium, 3.0% zinc, 0.35% tin, 0.5% trace elements and the remainder being aluminum. Conversely, each cylinder insert 46 is preferably made of an aluminum alloy having a melting point higher than that of the mounting plate 48 and heat sink 50, preferably 600 degrees Celsius or higher, and having a low silicon content, such as 6063-T6 aluminum. The chemical composition limits for the 6063-T6 aluminum are 0.20.6% silicon, 0.35% iron, 0.1% copper, 0.1% manganese, 0.45–0.9% magnesium, 0.1% chromium, 0.1% zinc, 0.1% titanium, 0.15% trace elements and the remainder being aluminum.

A low silicon content (less then 1% compared to more than 8% in standard die cast aluminum) is desired because silicon degrades in the anodizing process and breaks down and roughens the finish of a machined surface. Since the cylinder insert 46 has a low silicon content, the surface finish of the inner diameter will not degrade to the extent that standard die cast aluminum will. Thus, as mentioned, no post-anodized machining is required to re-establish a high surface finish at the inner diameter of the insert 46.

The mounting plate 48 includes bores for attaching the compression cylinders 38 over the cylinder openings of the crankcase 30 with suitable fasteners. In use, as the crankshaft 22 is rotated by the electric motor 20, heat is generated from the heat of compression and by sliding friction between the piston compression rings 52 and the inner diameter of the cylinder insert 46 as the pistons 28 reciprocate within the compression cylinders 38. This heat is transferred via thermal conductivity through the cylinder insert 46 and to the heat sink 50 of each compression cylinder 38. The blower wheel 16 directs air past the exterior of the crankcase 30 (as shown by the arrows in FIG. 2) and the compression cylinders 38, including the heat sinks 50, which dissipates the heat according to the principles of convective heat transfer to provide effective cooling of the air compressor 10. As such, the crankcase 30 need not have openings for air to pass through to the interior of the crankcase 30. Rather, the crankcase 30 can be enclosed so as to reduce noise and prevent dust and debris from damaging internal moving parts, such as the bearings 26, compression rings 52 and cylinder inner walls.

An illustrative embodiment of the invention has been described in detail for the purpose of disclosing a practical, operative structure whereby the invention may be practiced advantageously. The novel characteristics of the invention, however, may be incorporated in other structural forms without departing from the scope of the invention. For example, the heat sink and mounting plate of the above described embodiment have a higher silicon content than the cylinder insert to lower cost and to provide a more suitably cast material, however, they too could be made of a low silicon aluminum alloy. Moreover, the melting point of the cylinder insert need not be higher than the heat sink and mounting plate, provided the insert is suitably cooled during the casting process. Accordingly, in order to apprise the public of the full scope of the present invention, reference should be made to the following claims.

What is claimed is:

1. A cooling system for an oilless air compressor having a drive unit operating a crankshaft disposed within a crankcase and to which is attached a piston movable within a compression cylinder, the cooling system comprising:

a thermally conductive aluminum alloy cylinder insert defining a bore of the compression cylinder in which the piston rides; and a thermally conductive aluminum alloy heat sink connected to the crankcase and cast integrally to the outer diameter of the cylinder insert;

wherein the crankcase is enclosed with no external openings for allowing outside air into the crankcase; and wherein the cylinder insert and the heat sink are made of different aluminum alloys.

2. The cooling system of claim 1, wherein the cylinder insert has a silicon content less than that of the heat sink.

3. The cooling system of claim 2, wherein the silicon content is sufficiently low in order to machine finish the bore of the cylinder insert and anodize the bore after machine finishing without re-machining the bore.

4. A cooling system for an oilless air compressor having a drive unit operating a crankshaft disposed within a crankcase and to which is attached a piston movable within a compression cylinder, the cooling system comprising:

a thermally conductive aluminum alloy cylinder insert defining a bore of the compression cylinder in which the piston rides; and a thermally conductive aluminum alloy heat sink connected to the crankcase and cast integrally to the outer diameter of the cylinder insert;

wherein the crankcase is enclosed with no external openings for allowing outside air into the crankcase;

wherein the cylinder insert and the heat sink are made of different aluminum alloys;

wherein a silicon content of the cylinder insert is less than that of the heat sink; and wherein the silicon content of the cylinder insert is less than one percent.

5. The cooling system of claim 4, wherein the cylinder insert is extruded and the inner bore is anodized.

6. The cooling system of claim 5, wherein the heat sink is die cast about the cylinder insert.

7. The cooling system of claim 6, wherein the cylinder insert has a higher melting point than the heat sink.

8. A cooling system for an oilless air compressor having a drive unit operating a crankshaft disposed within a crankcase and to which is attached a piston movable within a compression cylinder, the cooling system comprising:

a thermally conductive aluminum alloy cylinder insert defining a bore of the compression cylinder in which the piston rides; and a thermally conductive aluminum alloy heat sink connected to the crankcase and cast integrally to the outer diameter of the cylinder insert;

wherein the crankcase is enclosed with no external openings for allowing outside air into the crankcase; and wherein a silicon content of the cylinder insert is less than one percent.

9. The cooling system of claim 8, further comprising a blower wheel concentrically mounted to the crankshaft adjacent the exterior of the crankcase.

10. The cooling system of claim 9, wherein the air compressor includes multiple compression cylinders in each of which a corresponding piston travels.

11. The cooling system of claim 10, wherein the heat sink includes a plurality of annular fins.

12. An oilless air compressor, comprising:

a positive displacement compressor unit having a reciprocating piston movable within a compression cylinder, wherein the compression cylinder is comprised of a thermally conductive cylinder insert made of an aluminum alloy having a low silicon content and a thermally conductive aluminum alloy heat sink cast integrally to the outer diameter of the cylinder insert;

a drive unit driving a crankshaft within a crankcase to reciprocate the piston within the compression cylinder; and a blower wheel external to the crankcase and rotated by the drive unit to direct air past the heat sink;

wherein the crankcase is enclosed with substantially no external openings allowing a flow of outside air into the crankcase;

wherein the cylinder insert has a silicon content of less than one percent and the inner bore is anodized.

13. The air compressor of claim 12, wherein the heat sink is die cast about the cylinder insert.

14. The air compressor of claim 13, wherein the cylinder insert has a higher melting point than the heat sink.

15. The air compressor of claim 12, wherein the compressor includes multiple compression cylinders in each of which a corresponding piston travels.

16. The air compressor of claim 12, wherein the heat sink includes a plurality of annular fins.

* * * * *